US010041485B2

(12) United States Patent
Medici

(10) Patent No.: US 10,041,485 B2
(45) Date of Patent: Aug. 7, 2018

(54) TWO-WAY HAND-DRAWN PNEUMATIC CYLINDER PISTON

(71) Applicant: GRI LEISURE AND SPORT EQUIPMENT CO., LTD., Zhejiang (CN)

(72) Inventor: Gaetano Medici, Brignano Gera d'Adda (IT)

(73) Assignee: Gri Leisure and Sport Equipment Co., Ltd., Mahe (SC)

( * ) Notice: Subject to any disclaimer, the term of this patent is extended or adjusted under 35 U.S.C. 154(b) by 0 days.

(21) Appl. No.: 14/917,231

(22) PCT Filed: Jul. 1, 2015

(86) PCT No.: PCT/CN2015/000482

§ 371 (c)(1),
(2) Date: Mar. 7, 2016

(87) PCT Pub. No.: WO2016/008279

PCT Pub. Date: Jan. 21, 2016

(65) Prior Publication Data

US 2017/0114781 A1 Apr. 27, 2017

(30) Foreign Application Priority Data

Jul. 14, 2014 (CN) ..... 2014 1 0333280

(51) Int. Cl.
*F04B 33/00* (2006.01)
*F04B 53/14* (2006.01)
*F04B 39/00* (2006.01)

(52) U.S. Cl.
CPC ..... *F04B 33/00* (2013.01); *F04B 39/00* (2013.01); *F04B 53/14* (2013.01); *F04B 33/005* (2013.01); *F04B 39/0016* (2013.01)

(58) Field of Classification Search
CPC ..... F04B 33/00; F04B 33/005; F04B 39/00; F04B 39/102; F04B 53/14; F04B 39/0016
(Continued)

(56) References Cited

U.S. PATENT DOCUMENTS 5,213,169 A * 5/1993 Heller ..... E21B 4/20 173/185
6,648,615 B2 * 11/2003 Tsai ..... F04B 33/00 417/521
2010/0278670 A1 * 11/2010 Tsai ..... F04B 53/126 417/546

FOREIGN PATENT DOCUMENTS

CN 103362776 A * 10/2013

OTHER PUBLICATIONS

English Translation of CN 103362776 A (Vittoria) dated Mar. 7, 2018.*

* cited by examiner

*Primary Examiner* — Dominick L Plakkoottam
*Assistant Examiner* — Connor Tremarche
(74) *Attorney, Agent, or Firm* — Wang Law Firm, Inc.

(57) ABSTRACT

A piston for dual-directional hand inflator comprises a main body (1) having an internal hole (11) and an external hole (12). A plurality of spacers (17) are disposed between the top surface and the bottom surface of the main body (1) and divide a space into a gas-intake guide chamber (3) and a gas-exhaust guide chamber (5). The gas-intake guide chamber (3) communicates with the internal hole (11), and the gas-exhaust guide chamber (5) communicates with the external hole (12). A first cover plate (6) is disposed at an end of the gas-intake guide chamber to seal the gas-intake guide chamber. A second cover plate (7) is disposed at an end of the gas-exhaust guide chamber to seal the gas-exhaust guide chamber. There is only two cover plate to be adhered
(Continued)

and fixed. The assembly is more convenient and the leakage probability is reduced.

5 Claims, 3 Drawing Sheets

(58) Field of Classification Search
USPC ..... 417/546
See application file for complete search history.

TWO-WAY HAND-DRAWN PNEUMATIC CYLINDER PISTON

RELATE APPLICATIONS

This application is a national phase entrance of and claims benefit to PCT Application for a piston for dual-directional hand inflator, PCT/CN2015/000482, filed on Jul. 1, 2015, which claims benefit to Chinese Patent Application 201410333280.8, filed on Jul. 14, 2014. The specifications of both applications are incorporated herein by this reference.

FIELD OF THE INVENTION

The present invention relates to a piston for dual-directional hand inflator.

DESCRIPTION OF THE PRIOR ART

At present, there are many kinds of hand inflators (also called inflator pumps), among which a hand inflator enabling an inflating action both in dual-directional strokes of pushing and pulling is available. Such an inflator has an advantage of high inflating efficiency.

Chinese Patent CN2450405Y, titled "DUAL-DIRECTIONAL INFLATOR PUMPS" and Chinese Patent CN2874057Y, titled "DUAL-DIRECTIONAL INFLATOR PUMP" both disclosed a hand inflator which can enable dual-directional inflation.

A piston of such a hand inflator which can enable dual-directional inflation has a following characteristic: a gas-intake guide chamber and a gas-exhaust guide chamber are provided in the interior of the piston, a unidirectional port enabling air to enter the main body from the gas-intake guide chamber is formed on surfaces of the piston above and below the gas-intake guide chamber, and a unidirectional port enabling air to enter the gas-exhaust guide chamber from the main body is formed on surfaces of the piston above and below the gas-exhaust guide chamber.

Such a piston has a following defect: four fittings (two pistons on sides and two valve seats) need to be welded and adhered onto each piston, which is high in labor cost. Additionally, as there are many components to be adhered, there is a high probability of leakage or falling-off of these fittings due to infirm welding or adhesion. Furthermore, as the piston ring is directly mounted in the periphery of the main body and thus occupies a certain superficial area of the piston, the area for arranging ports on the piston is small, and the gas supply capacity of the piston is small. Such a piston when used in a hand inflator will be labor consuming.

SUMMARY OF THE INVENTION

A technical problem to be solved by the present invention is, in view of the prior art, to provide a piston for dual-directional hand inflator having a small number of components to be adhered, which has advantages of convenient assembly, small leakage probability and low cost.

To solve this technical problem, a piston for dual-directional hand inflator comprises a main body with a top surface and a bottom surface, having an internal hole for connecting to an inner tube and an external hole surrounding the internal hole for connecting to an outer tube, both holes formed in the center of the main body; a sealing ring disposed around the periphery of the main body; a first port and a second port provided on the top surface of the main body; a third port and a fourth port provided on the bottom surface of the main body; and a valve provided on each port; wherein the wall of the external hole protrudes upwardly from the top surface of the main body; a plurality of spacers are disposed between the top surface and the bottom surface of the main body and divide a space between the top surface and the bottom surface into a gas-intake guide chamber and a gas-exhaust guide chamber, the gas-intake guide chamber and the gas-exhaust guide chamber are not in communication with each other; the gas-intake guide chamber communicates with the internal hole, and the gas-exhaust guide chamber communicates with the external hole; a first cover plate is disposed at an end of the gas-intake guide chamber to seal the gas-intake guide chamber; a second cover plate is disposed at an end of the gas-exhaust guide chamber to seal the gas-exhaust guide chamber; and the first port and the third port communicate with the gas-intake guide chamber, and the second port and the fourth port communicate with the gas-exhaust guide chamber.

Two first recesses are provided at the end of the gas-intake guide chamber for engaging the first cover plate; the first cover plate has a top surface, a bottom surface, and two first joining walls, each first joining wall engages a spacer, and the top surface and the bottom surface of the first cover plate respectively engages the corresponding first recesses. With this structure, a contact space having a larger area is formed between the first cover plate and the gas-intake guide chamber, and this ensures firm adhesion between the first cover plate and the gas-intake guide chamber.

Two second recesses are provided at the end of the gas-exhaust guide chamber for engaging the second cover plate; the second cover plate has a top surface, a bottom surface, and two joining walls, each second joining wall engages a spacer, and the top surface and the bottom surface of the second cover plate respectively engages the corresponding second recesses. With this structure, a contact space having a larger area is formed between the second cover plate and the gas-exhaust guide chamber, and this ensures firm adhesion between the second cover plate and the gas-exhaust guide chamber.

Each valve has a center rod; a first ring portion for the center rod to pass through is provided in the center of the first port, a plurality of first connecting ribs are radially arranged between a periphery of the first ring portion and an inner wall of the first port; a second ring portion for the center rod to pass through is provided in the center of the second port, a plurality of second connecting ribs are radially arranged between a periphery of the second ring portion and an inner wall of the second port; a third ring portion for the center rod to pass through is provided in the center of the third port, a plurality of third connecting ribs are radially arranged between a periphery of the third ring portion and an inner wall of the third port; a fourth ring portion for the center rod to pass through is provided in the center of the fourth port, a plurality of fourth connecting ribs are radially arranged between a periphery of the fourth ring portion and an inner wall of the fourth port.

A plurality of stiffened plates is provided between the top surface of the main body and the periphery of the external hole, each stiffened plate having a triangular shape. This structure is preferred.

In order to strength the overall strength of the main body, two supporting plates are provided between the top surface and the bottom surface of the main body.

As a further improvement, an annular extending wall is formed at the bottom surface of the main body, the annular extending wall has an annular groove for receiving the sealing ring. Additionally, since the annular groove into which the sealing ring is mounted is located below the main body, such a special construction of the main body may utilize the maximum available space. Hence, with the use of this piston, on the premise of a same diameter, compared with a common piston, larger ports may be used. That is, the valve having the maximum size may be mounted in the ports of the piston to ensure the maximum gas flow. Even when the diameter of the piston is reduced, large ports are still ensured, and this significantly increases the gas flow of the piston. Large gas flow of the piston is very important for a pump of this type. A larger gas flow provides for small tensile force of the hand inflator, labor-saving effect and convenient use during the use of the piston.

Compared with the prior art, in the present invention, the structural main body of the piston is the main body which is a single-piece component; and the end of the two chambers before completely assembled provide a space for mounting valves, and after valves are completely mounted, the two cover plates are adhered and fixed at the end of the chambers. In this way, the whole piston is completely mounted. Additionally, there are only two cover plate components to be adhered and fixed for a whole piston. Hence, the assembly is more convenient, the cost is low, and the leakage probability due to infirm adhesion is reduced.

DETAILED DESCRIPTION OF THE PREFERRED EMBODIMENT

Figure 1:
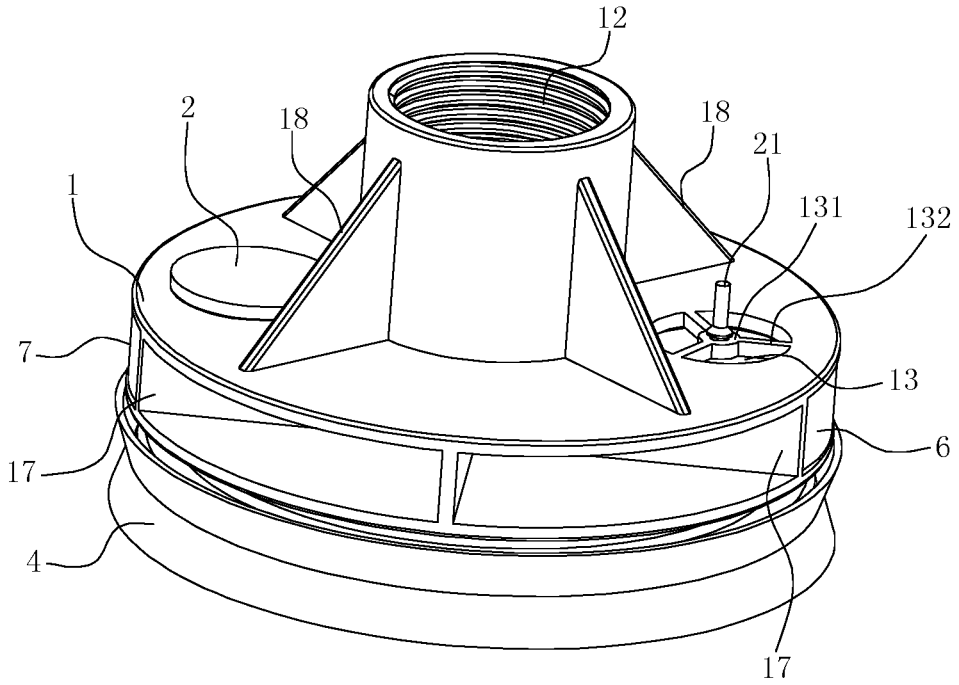
FIG. 1 is a perspective view from the front side of a piston for dual-directional hand inflator according to an embodiment of the present invention.
Figure 2:
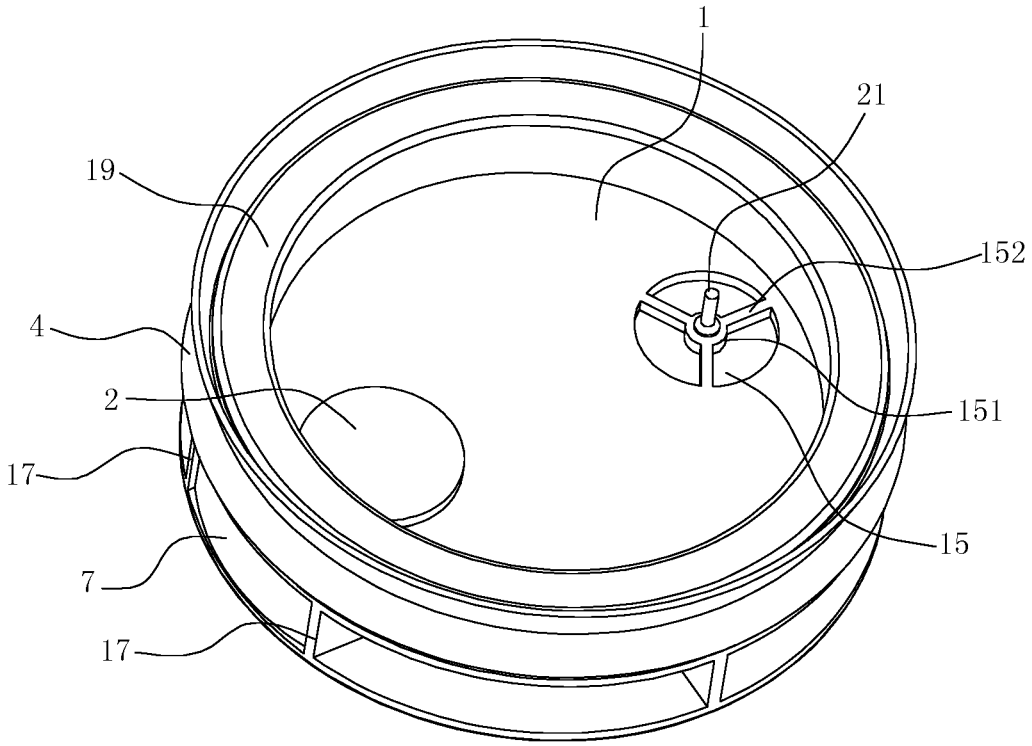
FIG. 2 is a perspective view from the rear side of the piston for dual-directional hand inflator according to the embodiment of the present invention.
Figure 3:
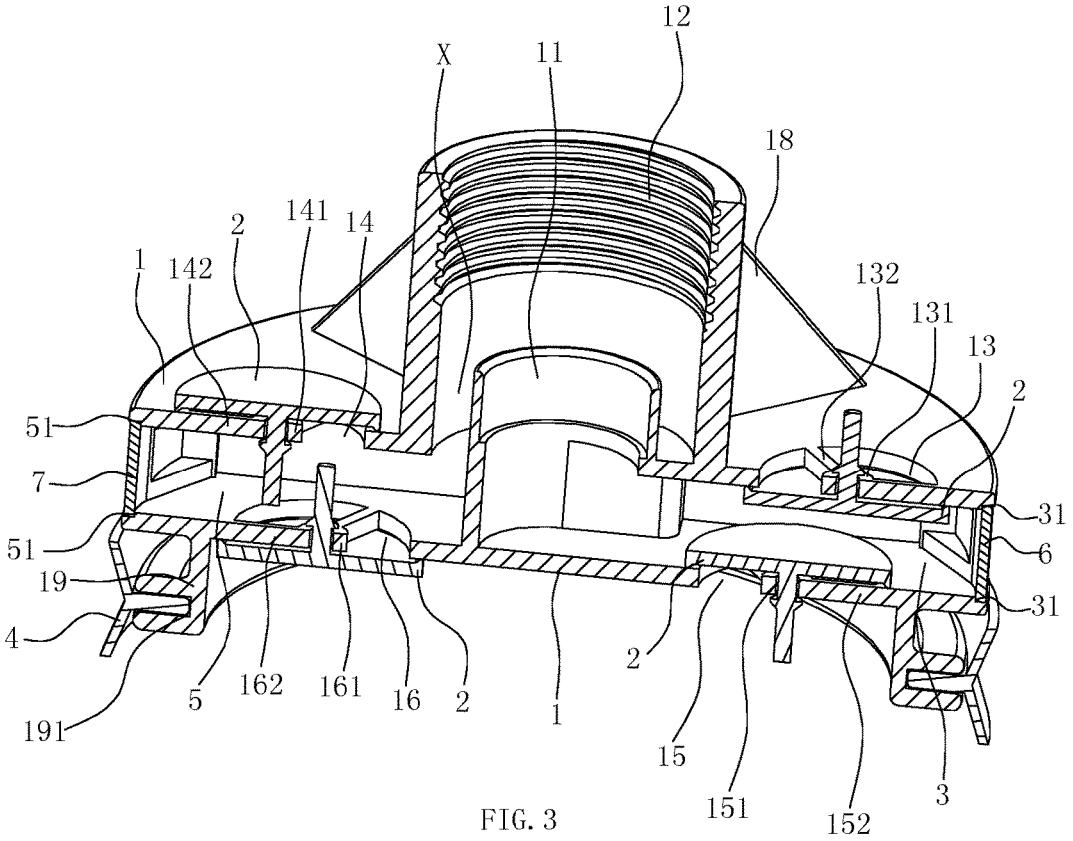
FIG. 3 is a sectional view of the piston for dual-directional hand inflator according to the embodiment of the present invention.
Figure 4:
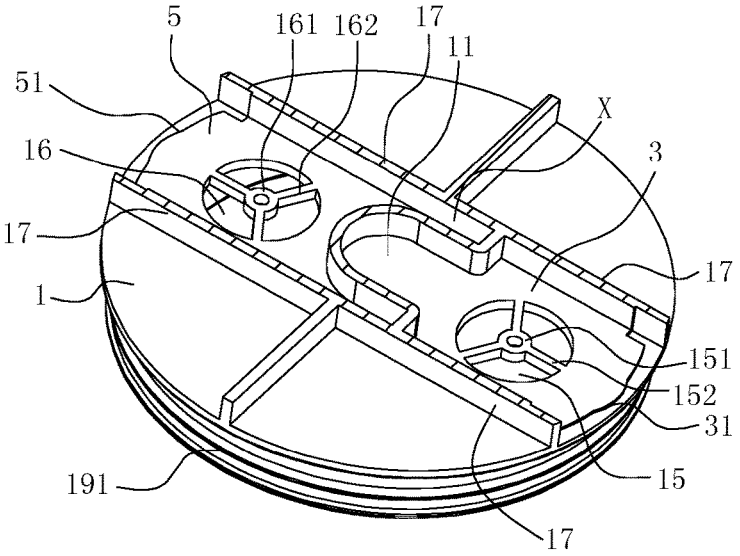
FIG. 4 is a sectional view of a main body of the piston for dual-directional hand inflator according to the embodiment of the present invention.
Figure 5:
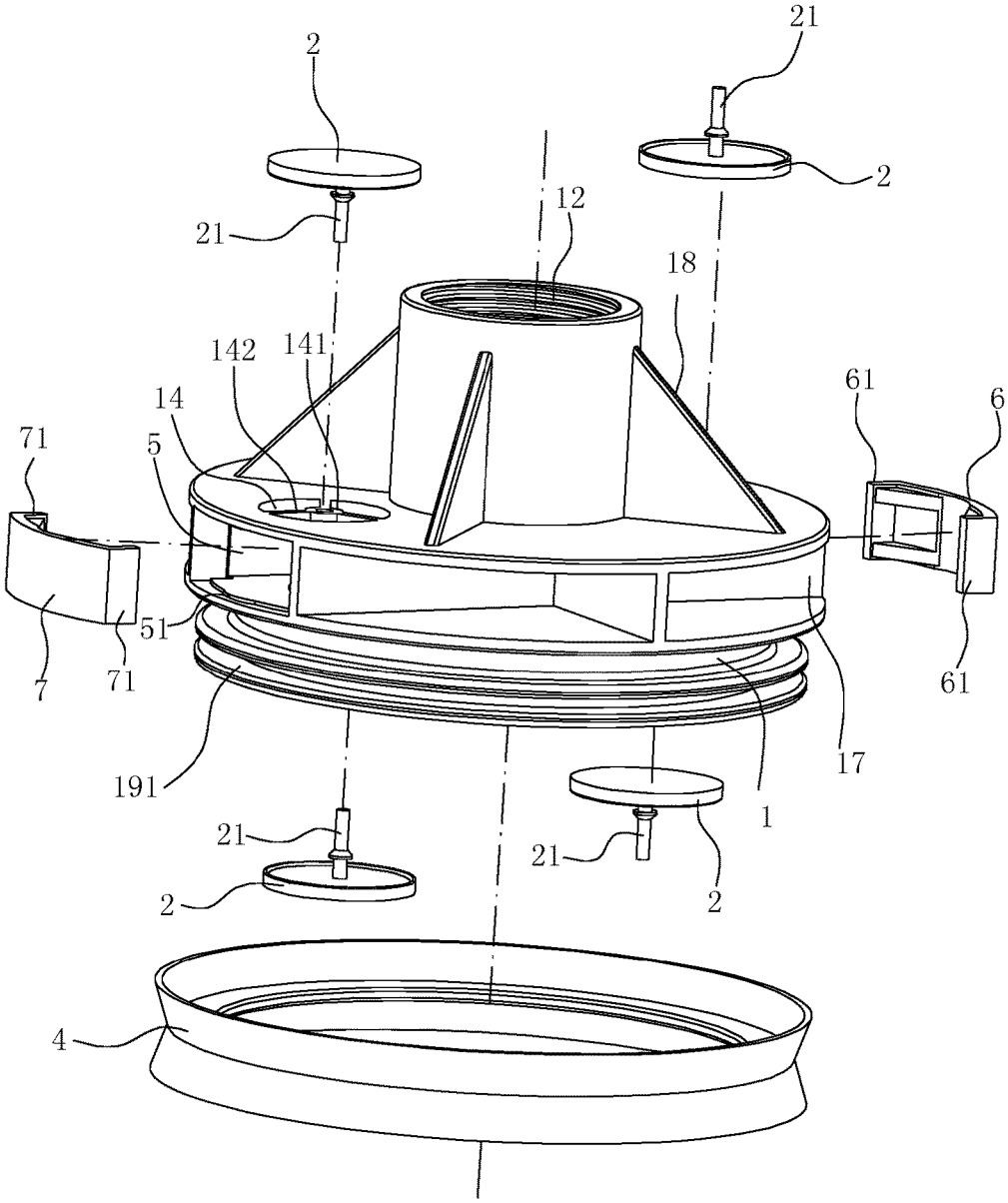
FIG. 5 is an exploded view of the piston for dual-directional hand inflator according to the embodiment of the present invention.

To enable a further understanding of the present invention content of the invention herein, refer to the detailed description of the invention and the accompanying drawings below:

FIG. 1-FIG. 3 show a preferred embodiment of a piston for dual-directional hand inflator. The piston for dual-directional hand inflator comprises a main body 1 with a top surface and a bottom surface, a sealing ring 4 disposed around the periphery of the main body 1, a first port 13 and a second port 14 provided on the top surface of the main body 1, a third port 15 and a fourth port 16 provided on the bottom surface of the main body 1, and a valve 2 provided on each port. The main body 1 is roughly round and a single-piece injection-molded member, has an internal hole 11 for connecting to an inner tube and an external hole 12 surrounding the internal hole 11 for connecting to an outer tube, both holes formed in the center of the main body 1. The wall of the external hole 12 protrudes upwardly from the top surface of the main body 1. A plurality of stiffened plates 18 are provided between the top surface of the main body 1 and the periphery of the external hole 12, each stiffened plate has a triangular shape.

A plurality of spacers 17 are radially disposed at intervals between the top surface and the bottom surface of the main body 1, and so as to divide a space between the top surface and the bottom surface into a gas-intake guide chamber 3 and a gas-exhaust guide chamber 5, the gas-intake guide chamber 3 and the gas-exhaust guide chamber 5 are not in communication with each other; the gas-intake guide chamber 3 communicates with the internal hole 11, and the gas-exhaust guide chamber 5 communicates with the space X between the wall of the internal hole 11 and the wall of the external hole 12, that is, the gas-exhaust guide chamber 5 communicates with the external hole 12. A first cover plate 6 is disposed at an end of the gas-intake guide chamber 3 to seal the gas-intake guide chamber; a second cover plate 7 is disposed at an end of the gas-exhaust guide chamber 5 to seal the gas-exhaust guide chamber. The first port 13 and the third port 15 communicate with the gas-intake guide chamber 3, and the second port 14 and the fourth port 15 communicate with the gas-exhaust guide chamber 5.

Two first recesses 31 are provided at the end of the gas-intake guide chamber 3 for engaging the first cover plate 6; the first cover plate has a top surface, a bottom surface, and two first joining walls, each first joining wall 61 engages a spacer 17, and the top surface and the bottom surface of the first cover plate 6 respectively engages the corresponding first recesses 31.

Two second recesses 51 are provided at the end of the gas-exhaust guide chamber 5 for engaging the second cover plate 7; the second cover plate has a top surface, a bottom surface, and two joining walls, each second joining wall 71 engages a spacer 17, and the top surface and the bottom surface of the second cover plate 7 respectively engages the corresponding second recesses 51.

Each valve 2 has a center rod 21; a first ring portion 131 for the center rod 21 to pass through is provided in the center of the first port 13, a plurality of first connecting ribs 132 are radially arranged between a periphery of the first ring portion 131 and an inner wall of the first port 13; a second ring portion 141 for the center rod 21 to pass through is provided in the center of the second port 14, a plurality of second connecting ribs 142 are radially arranged between a periphery of the second ring portion 141 and an inner wall of the second port 14; a third ring portion 151 for the center rod 21 to pass through is provided in the center of the third port 15, a plurality of third connecting ribs 152 are radially arranged between a periphery of the third ring portion 151 and an inner wall of the third port 15; a fourth ring portion 161 for the center rod 21 to pass through is provided in the center of the fourth port 16, a plurality of fourth connecting ribs 162 are radially arranged between a periphery of the fourth ring portion 161 and an inner wall of the fourth port 16;

An extending wall 19 is formed at the bottom surface of the main body 1, the annular extending wall 19 has an annular groove 191 for receiving the sealing ring 4.

The component of the piston in the present invention is the main body 1 which is a single-piece component; and the end of the two chambers 3, 5 before completely assembled provide a space for mounting valves 2, and after valves 2 are completely mounted, the two cover plates 6 and 7 are adhered and fixed at the end of the chambers 3, 5. In this way, the whole piston is completely mounted. Additionally, there are only two cover plate components 6 and 7 to be adhered and fixed for a whole piston. Hence, the assembly is more convenient, the cost is low, and the leakage probability due to infirm adhesion is reduced.

Since the annular groove 191 into which the sealing ring 4 is mounted is located below the main body 1, such a special construction of the main body 1 may utilize the maximum available space. Hence, with the use of this piston, on the premise of a same diameter, compared with a common piston, larger ports 13, 14, 15 and 16 may be used. That is, each valve 2 has the maximum size and can be mounted on the ports 13, 14, 15 and 16 of the piston to ensure the maximum gas flow. Even when the diameter of the piston is reduced, large ports are still ensured, and this significantly increases the gas flow of the piston. Large gas flow of the piston is very important for a pump of this type. A larger gas flow provides for small tensile force of the hand inflator, labor-saving effect and convenient use during the use of the piston.

The invention claimed is:

1. A piston for dual-directional hand inflator, comprising a main body with a top surface and a bottom surface, having an internal hole for connecting to an inner tube and an external hole surrounding the internal hole for connecting to an outer tube, both holes formed in the center of the main body;

a sealing ring disposed around a periphery of the main body;

a first port and a second port provided on the top surface of the main body;

a third port and a fourth port provided on the bottom surface of the main body; and a valve provided on each port;

wherein the wall of the external hole protrudes upwardly from the top surface of the main body;

a plurality of spacers are disposed between the top surface and the bottom surface of the main body and divide a space between the top surface and the bottom surface into a gas-intake guide chamber and a gas-exhaust guide chamber, the gas-intake guide chamber and the gas-exhaust guide chamber are not in communication with each other;

the gas-intake guide chamber communicates with the internal hole, and the gas-exhaust guide chamber communicates with the external hole;

a first cover plate is disposed at an end of the gas-intake guide chamber to seal the gas-intake guide chamber, the first cover plate having a top surface, a bottom surface, and two first joining walls, each first joining wall engages a spacer;

two first recesses are provided at the end of the gas-intake guide chamber for engaging the first cover plate, the top surface and the bottom surface of the first cover plate respectively engages the corresponding first recesses;

a second cover plate is disposed at an end of the gas-exhaust guide chamber to seal the gas-exhaust guide chamber; and the first port and the third port communicate with the gas-intake guide chamber, and the second port and the fourth port communicate with the gas-exhaust guide chamber.

2. The piston of claim 1, wherein two second recesses are provided at the end of the gas-exhaust guide chamber for engaging the second cover plate;

the second cover plate has a top surface, a bottom surface, and two joining walls, each second joining wall engages a spacer, and the top surface and the bottom surface of the second cover plate respectively engages the corresponding second recesses.

3. The piston of claim 1, wherein each valve has a center rod;

a first ring portion for the center rod to pass through is provided in the center of the first port, a plurality of first connecting ribs are radially arranged between a periphery of the first ring portion and an inner wall of the first port;

a second ring portion for the center rod to pass through is provided in the center of the second port, a plurality of second connecting ribs are radially arranged between a periphery of the second ring portion and an inner wall of the second port;

a third ring portion for the center rod to pass through is provided in the center of the third port, a plurality of third connecting ribs are radially arranged between a periphery of the third ring portion and an inner wall of the third port;

a fourth ring portion for the center rod to pass through is provided in the center of the fourth port, a plurality of fourth connecting ribs are radially arranged between a periphery of the fourth ring portion and an inner wall of the fourth port.

4. The piston of claim 1, wherein a plurality of stiffened plates is provided between the top surface of the main body and a periphery of the external hole, each stiffened plate having a triangular shape.

5. The piston of claim 1, wherein an annular extending wall is formed at the bottom surface of the main body, the annular extending wall has an annular groove for receiving the sealing ring.

* * * * *